US009260679B2

(12) United States Patent
Craft

(10) Patent No.: US 9,260,679 B2
(45) Date of Patent: Feb. 16, 2016

(54) CLEANING COMPOSITION FOR THE FOOD AND BEVERAGE INDUSTRY

(71) Applicant: Madison Chemical Co., Inc., Madison, IN (US)

(72) Inventor: David M Craft, Madison, IN (US)

(73) Assignee: Madison Chemcial Co., Inc., Madison, IN (US)

( * ) Notice: Subject to any disclaimer, the term of this patent is extended or adjusted under 35 U.S.C. 154(b) by 147 days.

(21) Appl. No.: 13/896,415

(22) Filed: May 17, 2013

(65) Prior Publication Data

US 2014/0338703 A1 Nov. 20, 2014

(51) Int. Cl.

| | |
|---|---|
| ***B08B 9/00*** | (2006.01) |
| ***C11D 1/825*** | (2006.01) |
| *C11D 3/39* | (2006.01) |
| *C11D 1/722* | (2006.01) |
| *C11D 11/00* | (2006.01) |
| *B08B 3/00* | (2006.01) |
| *B08B 3/02* | (2006.01) |
| *B08B 3/04* | (2006.01) |

(52) U.S. Cl.

CPC ..... *C11D 1/825* (2013.01); *C11D 3/3947* (2013.01); *C11D 11/0041* (2013.01); *B08B 3/00* (2013.01); *B08B 3/02* (2013.01); *B08B 3/04* (2013.01); *C11D 1/722* (2013.01); *C11D 3/39* (2013.01); *C11D 11/0023* (2013.01); *C11D 11/0029* (2013.01)

(58) Field of Classification Search

CPC ..... C11D 3/39; C11D 1/722; C11D 11/0023; C11D 11/0029; C11D 11/0035; B08B 3/00; B08B 3/02; B08B 3/04

USPC ..... 510/421, 372, 375; 134/22.1, 22.17, 134/22.18, 22.19, 25.2, 25.3, 26, 27, 28, 36, 134/42

See application file for complete search history.

(56) References Cited

U.S. PATENT DOCUMENTS

| | | | | |
|---|---|---|---|---|
| 4,518,585 | A | 5/1985 | Greene et al. | |
| 4,557,898 | A | 12/1985 | Greene et al. | |
| 5,160,655 | A | 11/1992 | Donker et al. | |
| 5,492,540 | A | 2/1996 | Leifheit et al. | |
| 5,536,438 | A * | 7/1996 | Scialla | C11D 3/3947 510/238 |
| 5,891,392 | A | 4/1999 | Monticello et al. | |
| 6,106,774 | A | 8/2000 | Monticello et al. | |
| 6,113,654 | A | 9/2000 | Peterson | |
| 7,101,832 | B2 | 9/2006 | Asher et al. | |
| 7,354,604 | B2 | 4/2008 | Ramirez et al. | |
| 7,501,388 | B2 | 3/2009 | McClung | |
| 7,718,593 | B2 | 5/2010 | Micciche et al. | |
| 7,879,154 | B2 * | 2/2011 | Warkotsch et al. | 134/25.2 |
| 2003/0211050 | A1 * | 11/2003 | Majeti et al. | 424/49 |
| 2005/0019421 | A1 | 1/2005 | Hobbs et al. | |
| 2006/0052266 | A1 * | 3/2006 | Johnson | C11D 3/43 510/372 |
| 2007/0259802 | A1 * | 11/2007 | Heintz | C11D 1/825 510/375 |
| 2008/0139443 | A1 * | 6/2008 | Buzinski | C11D 1/835 510/362 |
| 2008/0251105 | A1 | 10/2008 | Toussaint et al. | |
| 2008/0287334 | A1 * | 11/2008 | Smith et al. | 510/220 |
| 2008/0305182 | A1 | 12/2008 | Ramirez et al. | |
| 2010/0292126 | A1 * | 11/2010 | Smith et al. | 510/376 |
| 2010/0298192 | A1 * | 11/2010 | Feenstra et al. | 510/223 |
| 2010/0300044 | A1 * | 12/2010 | Man | A01N 25/30 53/426 |
| 2012/0015859 | A1 | 1/2012 | Sieben et al. | |
| 2012/0083437 | A1 * | 4/2012 | Choczaj et al. | 510/299 |
| 2012/0213864 | A1 | 8/2012 | Mcclung | |
| 2012/0230869 | A1 | 9/2012 | Ramirez et al. | |
| 2012/0289449 | A1 | 11/2012 | Adamy | |
| 2012/0291815 | A1 * | 11/2012 | Monsrud et al. | 134/25.2 |
| 2014/0338703 | A1 * | 11/2014 | Craft | 134/22.1 |

FOREIGN PATENT DOCUMENTS

| | | | |
|---|---|---|---|
| CA | 2 225 589 | A1 | 12/1997 |
| CA | 2 276 165 | A1 | 12/1999 |
| JP | 2004-196852 | A | 7/2004 |
| WO | 98/21305 | A1 | 5/1998 |

OTHER PUBLICATIONS

Titova et al., "Solubility and Stability of Peroxosolvates Na4P2O7 * 3H2O2 and Na2HPO4 * H2O2 in Polyatomic Alcohols, Glycerol and Ethylene Glycol, and in Water-Alcohol Mixtures", Russian Journal of Applied Chemistry, vol. 78, No. 8, 2005, pp. 1373-1375. May 14, 2004.

* cited by examiner

*Primary Examiner* — Bibi Carrillo

(74) *Attorney, Agent, or Firm* — Posz Law Group, PLC; David Posz

(57) ABSTRACT

An aqueous cleaning composition and methods for use in the agricultural, food and beverage industry which comprises at least 3% of hydrogen peroxide and a plurality of non-ionic surfactants, wherein said cleaning composition is substantially free of any alkalinity source.

5 Claims, No Drawings

CLEANING COMPOSITION FOR THE FOOD AND BEVERAGE INDUSTRY

TECHNICAL FIELD

This disclosure is directed to a cleaning composition for use in the agricultural, food and beverage industry. It is especially useful in agricultural based industries such as the wine industry and other such industries which utilize large vessels that need cleaning on a continuous basis in view of the accumulation of mineral deposits and organic complexes, proteins, starches, soils and associated stains.

The disclosure further is directed to a method of cleaning vessels used in the agricultural, food and beverage industries which comprises diluting with water an aqueous composition which comprises at least 3% of hydrogen peroxide and a plurality of non-ionic surfactants, wherein said cleaning composition is substantially free of any alkalinity source and applying said diluted composition to said vessel in an amount necessary to clean said vessel of mineral deposits and/or organic complexes, proteins, starches, soils and associated stains, wherein said diluted composition comprises less than about 10% of said aqueous composition.

BACKGROUND

Agriculturally based industries including the food and beverage industry use equipment that must be cleaned frequently. Soils left behind from the production process generally consist of mineral deposits, organic complexes, proteins, starches, soils and associated stains. These soils and stains are generally cleaned with a highly alkaline cleaner composed of an alkalinity source, such as sodium hydroxide, potassium hydroxide, or sodium metasilicate, detergents, wetting agents, and possibly sodium hypochlorite. These alkaline cleaners are generally not effective at cleaning mineral deposits. Acidic cleaners are used to remove such mineral deposits and are generally composed of a blend of phosphoric acid and nitric acid, along with surfactants and detergents. These acidic cleaners are not very effective at cleaning organic complexes, proteins, starches, soils and associated stains. Thus, neither acidic nor alkaline cleaners are capable of effectively cleaning vessels which contain organic complexes, proteins, starches, soils and associated stains, as well as, mineral deposits.

Furthermore, such alkaline cleaners result in cation buildup which often results in harm to the environment such as osmotic pressure driving water out of root systems, leaf burning, plant stress, reduced water infiltration leading to increased runoff and erosion and reduced hydraulic conductivity. Thus, water management becomes difficult and expensive. Remediation is costly and continuous. In the end excess cation content can negatively affect the taste, yield and quality of a crop. This is especially damaging to industries, such as wineries, where such a result will be devastating to the business.

Thus, a cleaning composition that is effective at removing organic complexes, proteins, starches, soils and associated stains, as well as, mineral deposits is greatly needed in the agricultural, food and beverage industry.

SUMMARY

Accordingly, present application relates to an aqueous cleaning composition for use in the food and beverage industry which comprises at least 3% of hydrogen peroxide and a plurality of non-ionic surfactants, wherein said cleaning composition is substantially free of any alkalinity source. Preferably, the composition is also substantially free of any phosphonate source as well. In another aspect, an organic acid is added to the composition.

Another embodiment provides for an aqueous cleaning composition for use in the food and beverage industry which comprises from 3-6% hydrogen peroxide, 1-10%, propoxylated and ethoxylated $C_8$-$C_{10}$ linear alcohols, 1-10% propoxylated and ethoxylated $C_6$-$C_{10}$ linear alcohols, 5-20% organic acid, rinse aids and defoamers and at least 50% water wherein said composition is substantially free of any alkalinity source and is substantially free of any phosphonate source wherein is said composition is capable of cleaning soils consisting of mineral deposits, organic complexes, proteins and starches.

The present application further relates to the use of such compositions to clean vessels used in the agricultural, food and beverage industries. Accordingly, such compositions are used in methods for cleaning vessels used in such industries by applying said compositions to said vessel by spraying, foaming and immersion.

DETAILED DESCRIPTION

An aqueous cleaning composition for use in the food and beverage industry will be described herein. The composition is defined by certain ingredients in the amounts specified. Accordingly, an aqueous cleaning composition for use in the food and beverage industry comprises at least 3% by weight of hydrogen peroxide and a plurality of non-ionic surfactants, wherein said cleaning composition is substantially free of any alkalinity source. Preferably, the composition is also substantially free of any phosphonate source as well.

Further, the use of such compositions to clean vessels used in the agricultural, food and beverage industries. Accordingly, such compositions are used in methods for cleaning vessels used in such industries by applying said compositions to said vessel by spraying, foaming and immersion. One such method provides for a method of cleaning vessels used in the agricultural, food and beverage industries which comprises diluting with water an aqueous composition which comprises at least 3% of hydrogen peroxide and a plurality of non-ionic surfactants, wherein said cleaning composition is substantially free of any alkalinity source and applying said diluted composition to said vessel in an amount necessary to clean said vessel of mineral deposits and/or contain organic complexes, proteins, starches, soils and associated stains, wherein said diluted composition comprises less than about 10% of said aqueous composition.

One aspect is that the composition is substantially free of any alkalinity source and in another aspect it is substantially free of any phosphonate source. Thus, the composition is substantially free of any alkali in one embodiment and substantially free of any alkali and phosphonate in another embodiment. The term "substantially free" as used herein means that the composition is free from any amount of alkali and/or phosphonate which would prove harmful to the environment by, for example, increasing osmotic pressure driving water out of root systems, leaf burning, plant stress, reduced water infiltration leading to increased runoff and erosion and reduced hydraulic conductivity. The compositions are substantially free by utilizing ingredients that do not contain alkali and/or phosphonate. A composition would be considered to be "substantially free" of alkali and/or phosphonate sources if any such composition contained alkali and/or phosphonate resulting from unknown sources that were not intentionally added to the composition and in an amount that did no harm to the environment as described above.

The expression of quantity in terms of percent means the percentage by weight, relative to the weight of the total composition.

The term "about" when used to modify a numeric quantity of an ingredient in the compositions of the invention or employed in the methods of the invention refers to a minor variation in the numerical quantity that can occur through inadvertent error, differences in source or purity and the like.

A key ingredient in the cleaning composition is hydrogen peroxide. Hydrogen peroxide can be a very active material. As such, hydrogen peroxide can be added as such or it can be added in the form of a stabilized composition. Examples of stabilized hydrogen peroxides include Peroxy Blend (Akzo Nobel), Peroxy Base 2 (Burlington Chemical Co.), or Peroxy Green 2 (Hubbard Hall). If a stabilized blend of hydrogen peroxide is used, the amount of hydrogen peroxide in the cleaning composition should total at least 3 percent of said cleaning composition even though the amount of stabilized blend may be more. For example if a stabilized blend contains 31% hydrogen peroxide, the amount of the stabilized blend should be at least about 10 percent of the cleaning composition so that said cleaning composition contains at least 3 percent hydrogen peroxide.

As noted above, the disclosed compositions require the use of a plurality of non-ionic surfactants. Preferred non-ionic surfactants include alkoxylated alcohols, such as propoxylated and ethoxylated $C_8$-$C_{10}$ linear alcohols and propoxylated and ethoxylated $C_6$-$C_{10}$ linear alcohols. Other non-ionic surfactants that can be used are interdispersed ethoxylated-propoxylated alcohols, block ethoxylated-propoxylated alcohols, ethoxylated phenol, propoxylated alkyl phenols, alkyl polyglycoside, alkyl secondary alcohol ethoxylate, amine oxides and combinations thereof including Tomadol 23, 25, 45, 91 series, Nonidet SF-3 and SF-5, Plurafac B-25-2, Plurafac LF-7000, Pluronic N-3.

In one embodiment, an organic acid is added to the composition. Many organic acids can be used including citric acid, lactic acid, malic acid, gluconic acid, acetic acid, phosphoric acid, oxalic acid, sulfamic acid and substituted and non-substituted and combinations thereof An especially useful acid is acetic acid and substituted acetic acid, such as hydroxyl acetic acid.

To aid in cleaning, other adjuvants such as rinse aids and defoamers can be added. Such rinse aids and defoamers include block copolymers of propylene oxide and ethylene oxide, silicone emulsions, modified silicones, and polysiloxane including T-DET EPO series, Pluronic L, P, and R series, Dee Fo PI series, Foam BanMS series, and Silicone AF-8805, 8810, 8820, and 8830.

The above described embodiments will be further appreciated in light of the following examples which are provided as being illustrative of the invention and not to limit its scope.

EXAMPLE 1

| Component | % By Weight | Type of Component |
|---|---|---|
| Deionized Water | 77.4 | Water |
| 31% Peroxy Blend | 10 | Stabilized Hydrogen Peroxide |
| T DET LF 416 | 2.5 | Alkoxylated Alcohol |
| Plurafac S405LF | 2.5 | Alkoxylated Linear Alcohol |
| T DET EPO 62LF | 7.5 | Polyalkylene Defoamer |
| FOAM BAN MS-455-3A | 0.1 | Siloxane Defoamer |

EXAMPLE 2

| Component | % By Weight | Type of Component |
|---|---|---|
| Deionized Water | 56.35 | Water |
| 31% Peroxy Blend | 20 | Stabilized Hydrogen Peroxide |
| T DET LF 416 | 2.5 | Alkoxylated Alcohol |
| Plurafac S405LF | 2.5 | Alkoxylated Linear Alcohol |
| T DET EPO 62LF | 7.5 | Polyalkylene Defoamer |
| FOAM BAN MS-455-3A | 0.1 | Siloxane Defoamer |
| Hydroxy Acetic Acid 70% | 10 | Organic Acid |

T DET LF Series and Plurafac SLF Series are propoxylated or ethoxylated $C_8$-$C_{10}$ linear alcohols made by T DET by Harcros Organics of Kansas City, Mo. and Plurafac BASF.

Plurafac 5400 Series are propoxylated or ethoxylated C6-C10 linear alcohols made by BASF.

T DET EPO Series are polyethylene-polypropylene glycols made by Harcros Organics of Kansas City, Mo.

Testing was done in field trials using 1-2% solution, applied by spray for 30 minutes, with photographs of the surfaces before and after cleaning, comparing visual appearance. The tests illustrated that the compositions of Examples 1 and 2 were highly effective in cleaning mineral deposits as well as organic complexes.

As shown and described herein, the disclosed embodiments are highly effective in cleaning and removing organic complexes, proteins, starches, soils and associated stains, as well as, mineral deposits from vessels used in the agricultural, food and beverage industries.

This disclosure is intended to explain how to fashion and use various embodiments in accordance with the invention rather than to limit the true, intended, and fair scope and spirit thereof The foregoing description is not intended to be exhaustive or to limit the invention to the precise form disclosed. Modifications or variations are possible in light of the above teachings. The embodiment(s) was chosen and described to provide the best illustration of the principles of the invention and its practical application, and to enable one of ordinary skill in the art to utilize the invention in various embodiments and with various modifications as are suited to the particular use contemplated. All such modifications and variations are within the scope of the invention as determined by the appended claims, as may be amended during the pendency of this application for patent, and all equivalents thereof, when interpreted in accordance with the breadth to which they are fairly, legally, and equitably entitled.

What is claimed is:

1. A method of cleaning vessels used in the agricultural, food and beverage industry consisting of:

diluting with water an aqueous composition consisting of about 3-6% hydrogen peroxide, a plurality of non-ionic surfactants are alkoxylated alcohols selected from the group consisting of about 1-10%, propoxylated and ethoxylated $C_8$-$C_{10}$ linear alcohols, and about 1-10% propoxylated and ethoxylated $C_6$-$C_{10}$ linear alcohols and combinations thereof, about 5-20% organic acid, rinse aids and defoamers and at least about 50% water wherein said composition is substantially free of any alkalinity source and is substantially free of any phosphonate source; and applying the cleaning composition to a vessel in an amount necessary to clean the vessel of mineral deposits and/or organic complexes, proteins, starches, soils and associated stains.

2. A method of cleaning vessels used in the agricultural, food and beverage industry consisting of:

diluting with water an aqueous composition consists of about 20% hydrogen peroxide, a plurality of non-ionic surfactants consisting of alkoxylated alcohols selected from the group consisting of about 2.5% propoxylated and ethoxylated $C_8$-$C_{10}$ linear alcohols, and about 2.5% propoxylated and ethoxylated $C_6$-$C_{10}$ linear alcohols and combinations thereof, about 10% organic acid, about 7.5% defoamer, about 0.1% siloxane and an amount of deionized water so that the aqueous composition totals 100%; and applying the cleaning composition to a vessel in an amount necessary to clean the vessel of mineral deposits and/or organic complexes, proteins, starches, soils and associated stains.

3. A method of cleaning vessels consisting of:

diluting with water a cleaning composition consisting of 10% hydrogen peroxide, 2.5% alkoxylated alcohol, 2.5% alkoxylated linear alcohol, 7.5% polyalkylene defoamer; 0.1% siloxane defoamer, and 77.4% deionized water; and applying the cleaning composition to a vessel in an amount necessary to clean said vessel of mineral deposits and/or organic complexes, proteins, starches, soils and associated stains.

4. A method of cleaning vessels consisting of:

diluting with water a cleaning composition consisting of 20% hydrogen peroxide, 2.5% alkoxylated alcohol, 2.5% alkoxylated linear alcohol, 7.5% polyalkylene defoamer, 0.1% siloxane defoamer, 10% organic acid, and an amount of deionized water so that the cleaning composition totals 100%; and applying the cleaning composition to a vessel in an amount necessary to clean said vessel of mineral deposits and/or organic complexes, proteins, starches, soils and associated stains.

5. The method of claim 1, wherein said aqueous composition is applied by spraying, immersion or foaming.

* * * * *